US007544092B2

(12) United States Patent
Wu

(10) Patent No.: US 7,544,092 B2
(45) Date of Patent: Jun. 9, 2009

(54) PIN SOCKET WITH A RIB

(75) Inventor: Tsu-Yang Wu, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 20 days.

(21) Appl. No.: 11/646,844

(22) Filed: Dec. 27, 2006

(65) Prior Publication Data

US 2007/0149039 A1 Jun. 28, 2007

(30) Foreign Application Priority Data

Dec. 27, 2005 (CN) ..... 2005 2 0140439 U

(51) Int. Cl.
*H01R 13/73* (2006.01)

(52) U.S. Cl. ..... 439/573; 439/362; 439/733.1

(58) Field of Classification Search ..... 439/733.1, 439/362, 573, 570, 564, 469
See application file for complete search history.

(56) References Cited

U.S. PATENT DOCUMENTS 5,249,983 A * 10/1993 Hirai ..... 439/573
5,616,052 A * 4/1997 Pan et al. ..... 439/573
6,027,372 A * 2/2000 Lai et al. ..... 439/573
6,478,617 B2 * 11/2002 Fan ..... 439/570
7,037,131 B1 * 5/2006 Chen et al. ..... 439/372
7,331,818 B2 * 2/2008 Wu et al. ..... 439/573
2002/0068478 A1 * 6/2002 Watanabe ..... 439/573
2004/0219830 A1 * 11/2004 Fan ..... 439/570

* cited by examiner

*Primary Examiner*—Michael C Zarroli
(74) *Attorney, Agent, or Firm*—Wei Te Chung

(57) ABSTRACT

An electrical connector comprises a housing (1), a cover (2) mounted on the housing (1), a plurality of terminals (3) received in the housing (1), a pair of screw members (5) mounted on two ends of the housing (1) for connecting the housing (1) to a printed circuit board. The housing (1) defines an upper surface (11) and a pair of recesses (12) on two ends thereof for receiving the screw members (5), each recess (12) at least defines one triangle rib (13) for engaging interferential with the screw members (5). The triangle rib (13) is clear from the upper surface (11) of the housing (1).

17 Claims, 7 Drawing Sheets

PIN SOCKET WITH A RIB

BACKGROUND OF THE INVENTION

1. Field of the Invention

The present invention relates to an electrical connector, particularly to an electrical connector defined a screw member in two ends thereof.

2. Description of the Prior Art

A conventional electrical connector for connecting hard desk to a chip modules is disclosed in FIGS. 1-2. The electrical connector generally disposes a pair of screw members on two ends thereof for connecting with a printed circuit board. The electrical connector comprises an insulative housing. Due to the inferior intensity and anti-friction effect of the insulative material inherent, the housing always is inserted in a metal screw member for improving the using performance and the life span. The housing usually engages with the screw members by interfering ribs. Referring to the FIG. 1-2, the electrical connector comprises an insulative housing 1', a cover 2' mounted on the housing 1', a plurality of terminals 3' received in the housing 1', a securing member 4' and a screw member 5' disposed on two ends of the housing 1' for connecting the housing 1' to the printed circuit board. The housing 1' comprises an upper surface 11', a recess 12' indented in the upper surface 11' comprising a first recess 121', a second recess 122' and a third recess 123', a triangle rib 13' extending from a sidewall of the second recess 122'. The screw member 5' imbeds in the recess 12' with engaging interferentially with the triangle rib 13'. However, the screw member 5' engages interferentially with the recess 12' and a top end of the triangle rib 13' is coplanar with an upper surface 11' of the housing 1', which can make that the screw member 5' is difficultly inserted into the recess 12' of the housing 1' and decrease the efficacy of the assembly of the electrical connector.

BRIEF SUMMARY OF THE INVENTION

An object of the present invention is to provide an electrical connector able to simplify a process of imbedding screw members into the recesses.

An electrical connector in according with the prefer embodiment of the present invention comprises a housing, a cover mounted on the housing, a plurality of terminals received in the housing, a pair of screw members mounted on two ends of the housing for connecting the housing to a printed circuit board. The housing defines a upper surface and a pair of recesses on two ends thereof for receiving the screw members, each recess at least defines a pair of triangle ribs for engaging interferentially with the screw members, the triangle rib defines a top surface lower than the upper surface of the housing.

Relative to the present technology, the electrical connector in accordance with the prefer embodiment of the invention. The triangle rib with a inclined surface ensure the screw member accurately imbedded in the housing and provide a prepress effect, which can simplify the assembling process and decrease the assembling time.

Other objects, advantages and novel features of the invention will become more apparent from the following detailed description of a preferred embodiment when taken in conjunction with the accompanying drawings.

DETAILED DESCRIPTION OF THE PREFERRED EMBODIMENTS

Figure 1:
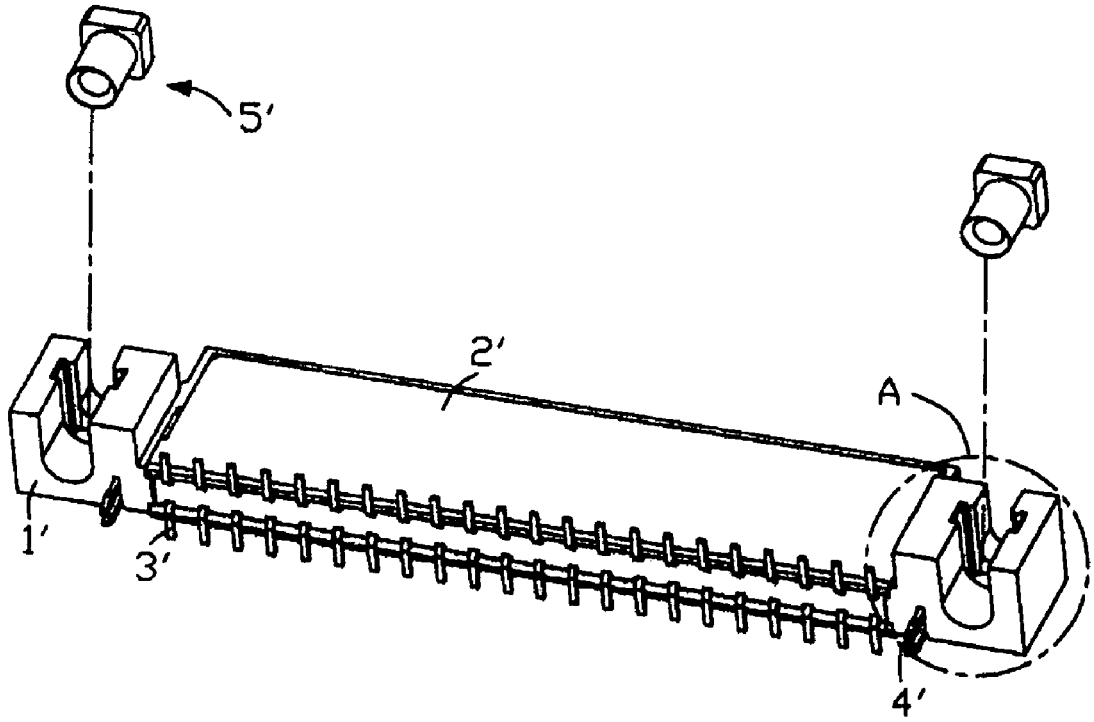
FIG. 1 is an isometric view of a conventional electrical connector wherein a screw member is not inserted into a housing.
Figure 2:
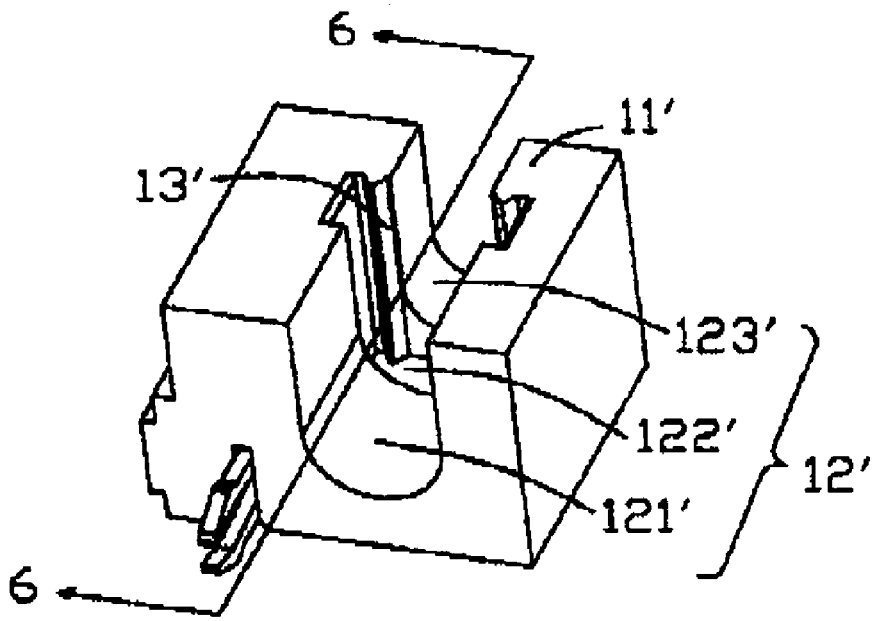
FIG. 2 is a magnified view of a circle A of the electrical connector described in FIG. 1.
Figure 3:
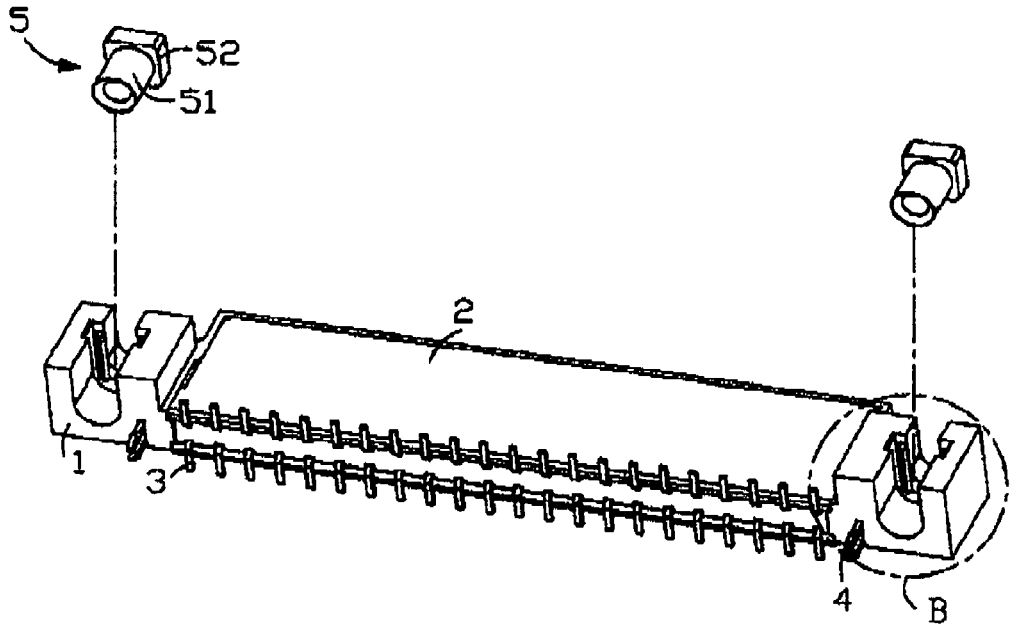
FIG. 3 is an isometric view of an electrical connector in accordance with the preferred embodiment of the invention, wherein a screw member is not inserted into a housing thereof.
Figure 4:
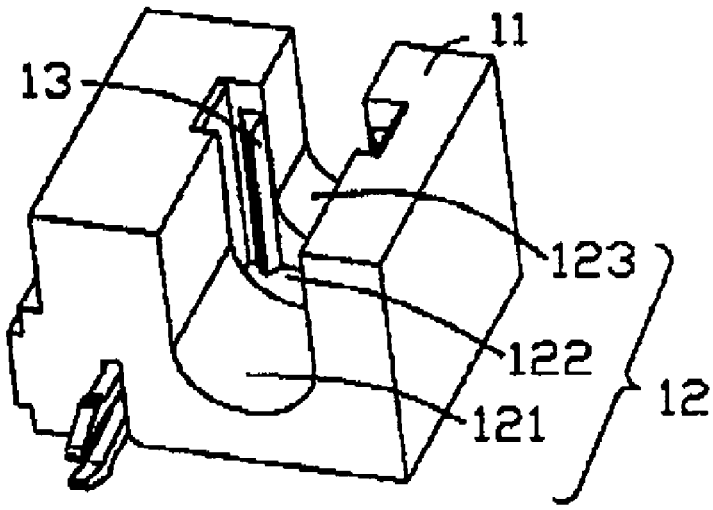
FIG. 4 a magnified view of a circle A of the electrical connector described in FIG. 3.

Referring to FIGS. 3-6, an electrical connector comprises a housing 1, a cover 2 mounted on the housing 1, a plurality of terminals 3 received in the housing 1 and a screw member 5 imbedded in the housing 1 for connecting the electrical connector to the printed circuit board. The housing 1 defines an upper surface 11, a recess 12 indented inwardly from the upper surface and a triangle rib 13 protruding on an inner wall of the recess 12. The recess 12 comprises a front section 121, a central section 122 and a distal section 123, wherein the front section 121 and the distal section 123 cooperatively from an U-shaped configuration and the central section 122 is indented deeper than the front section 121 and the distal section 123. And the width of the central section 122 is longer than that of the front section 121 and the distal section 123. In addition the central section 122 comprises a slant surface connecting with the upper surface 11 on each sidewall thereof, a rectangular-shaped bottom surface, a pair of triangle rib 13 extending from an inner wall of the central section 122 and defines a slant top surface 131 on an end adjacent to the upper surface 11 and lower than the upper surface 11. One point 132 of the top slant surface 131 engaging with screw member 5 is lower than the other two point 133, 134, of the top slant surface 131 in an inserting direction, and the two higher points 133, 134 can be coplanar with or lower than the upper surface 11 of the housing 1.

The screw member 5 for receiving a screw therein comprises a column section 51 and a four-side section 52, wherein the four-side section defines 51 a slant surface on each corner thereof for conveniently engaging with the triangle ribs 13.

Figure 5:
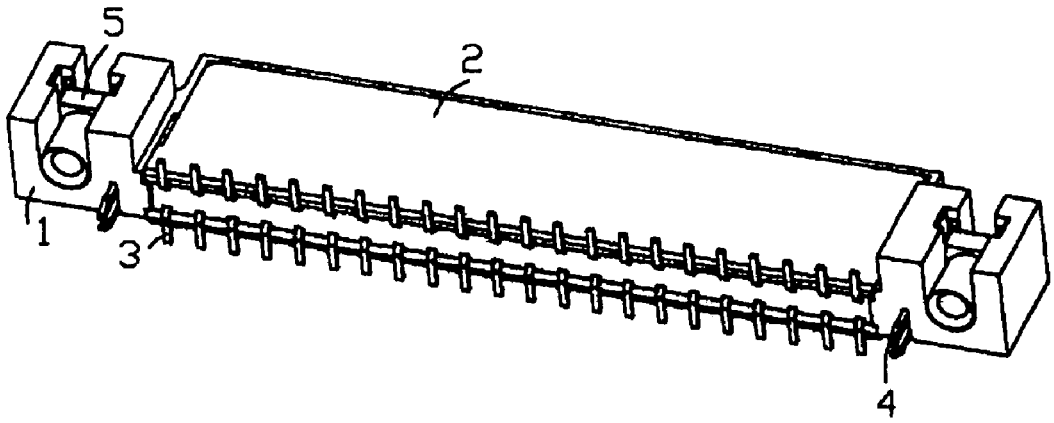
FIG. 5 is an assembled view of the electrical connector described in FIG. 4.
Figure 6:
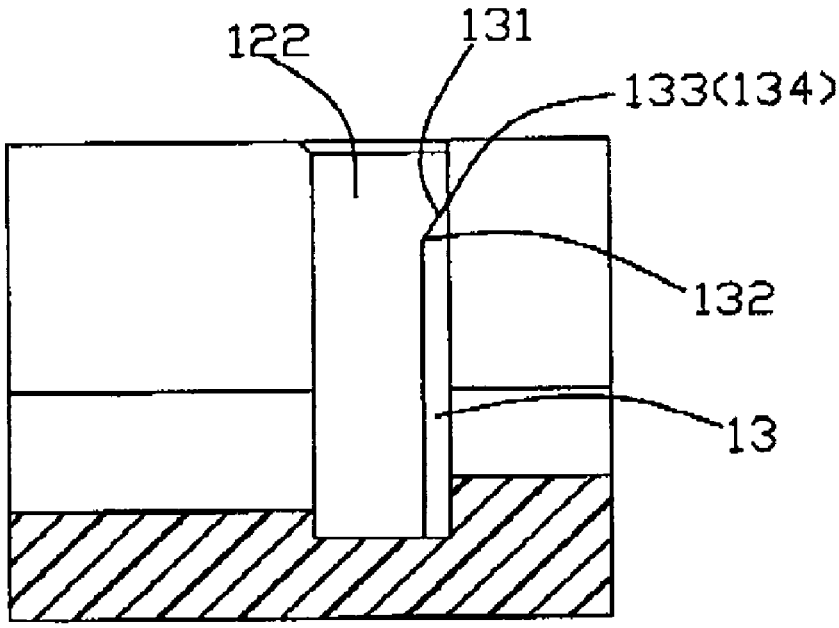
FIG. 6 is a cutview of the FIG. 4 along line 6-6.
Figure 7:
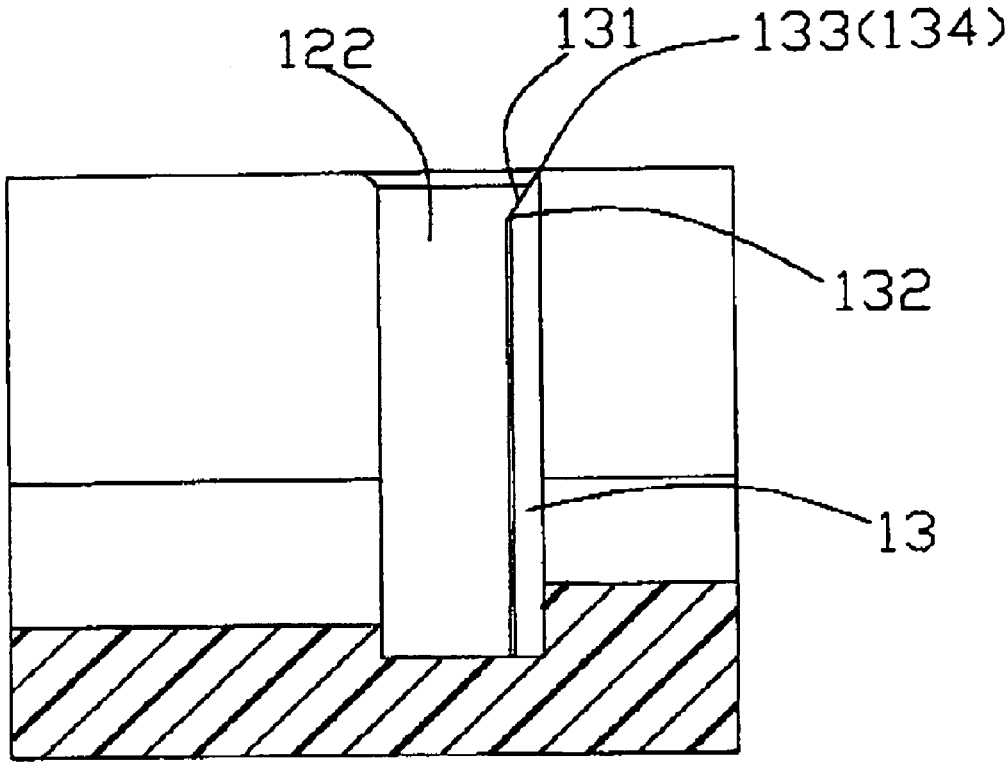
FIG. 7 is another cut view of the present invention, wherein the two higher pointes of the top slant surface is coplanar with the upper surface of the housing.

Referring also to FIG. 5, each terminal 3 received in the housing 1 comprises a tail extending through a passageway of the cover for connecting the cover 2 to the housing 1. The metal screw member 5 imbedded in the recess 12 by engaging interferential with the triangle rib 13. During the mounting the screw member 5 on the housing 1, the column section 51 of the screw member 5 is inserted in the front recess 121 of the housing 1, the rectangular section 52 is inserted in the central recess 122, the triangle rib 13 can locate and prepress the screw member 5 inserting into the housing 1, hence a preferred force can make the screw member 5 mounted in the recess 12 for realizing a simplified engagement between the screw member 5 and the housing 1.

Referring to the FIG. 5, as a improvement of the invention, the housing 1 disposes a pair of elongate channel for receiving the locking member 4 on two ends thereof, which can enforce the engagement between the electrical connector and the printed circuit board.

It will be understood that the invention may be embodied in other specific forms without departing from the spirit or central characteristics thereof. The present examples and embodiments, therefore, are to be considered in all respects as illustrative and not restrictive, and the invention is not be limited to the details given herein.

What is claimed is:

1. An electrical connector comprising:

a housing defining an upper surface and a pair of recesses on two ends thereof, wherein each recess at least defines one rib;

a plurality of terminals received in the housing;

a pair of screw members interferential received in the recesses of the housing;

wherein each rib is clear from the upper surface of the housing and defines a slant top surface on an end adjacent to the upper surface of the housing and an engaging section engaging with a corresponding screw member, and the height of said engaging section is not lower than that of the height of the screw member imbedded in the recess.

2. The electrical connector as claimed in claim 1, further comprising at least a locking member connecting the housing to a printed circuit board.

3. The electrical connector as claimed in claim, 2, wherein the housing defines at least one channel on a bottom surface for receiving the locking member therein.

4. The electrical connector as claimed in claim 1, wherein the height of the engage section is lower than that of the other parts thereof.

5. The electrical connector as claimed in claim 1, wherein the recess comprises a front section, a central section and a distal section.

6. The electrical connector as claimed in claim 5, wherein the front section and the distal section cooperatively define an U-shaped and the central section is indented deeper than the front section and the distal section.

7. The electrical connector as claimed in claim 1, wherein the recess has a bottom surface to support corresponding screw member.

8. The electrical connector as claimed in claim 1, wherein the rib is a triangle-shape from top view.

9. The electrical connector as claimed in claim 8, wherein one point of the top slant surface engaging with the screw member is lower than the other two point of the top slant surface in an inserting direction.

10. The electrical connector as claimed in claim 9, wherein the two higher points of the top slant surface can be coplanar with or lower than the upper surface of the housing.

11. The electrical connector as claimed in claim 6, wherein the width of the ventral section is longer than that of the front section and the distal section.

12. An electrical connector comprising:

a housing defining an upper surface and a pair of recesses on two ends thereof, wherein each recess at least defines one rib with a slant surface;

a plurality of terminals received in the housing;

a pair of screw members interferentially received in the recesses of the housing;

at least a locking member for connecting the housing to a printed circuit board, wherein each recess at least including a middle recess and two U-shaped recesses disposed at two opposite sides of the middle recess, wherein the width of the middle recess is loneer than that of any of the U-shaped recesses.

13. An electrical connector comprising:

a housing defining an upper surface with a pair of exposed recesses on two ends thereof, wherein each of said recesses is equipped with at least one protrusion therein to reduce an inner dimension of said recess;

a plurality of terminals received in the housing; and a pair of screw members dimensioned to essentially comply with the corresponding recesses and respectively interferentially, due to said protrusions, received in the recesses of the housing; wherein the screw members are assembled into the corresponding recesses from the upper surface downwardly in a vertical direction, and each protrusion is spaced away from the upper surface of the housing so as to allow the corresponding screw member to be inserted into the recess easily; wherein the recess includes a middle rectangular section and two U-shaped sections located at two opposite sides of the middle rectangular section, and wherein the protrusion is located in the middle rectangular section.

14. The electrical connector as claimed in claim 13, wherein said middle rectangular section is deeper than two U-shaped sections.

15. The electrical connector as claimed in claim 13, wherein a top point of said protrusion is higher than a top point of the corresponding screw member.

16. The electrical connector as claimed in claim 13, wherein said two U-shaped sections located at two opposite sides of the middle rectangular section in a front-to-back direction perpendicular to said vertical direction.

17. The electrical connector as claimed in claim 16, wherein said middle rectangular section is larger than the two U-shaped sections in a viewpoint along said front-to-back direction.

* * * * *